US007198115B2

(12) United States Patent
Cardoso

(10) Patent No.: US 7,198,115 B2
(45) Date of Patent: Apr. 3, 2007

(54) LEAD ALIGNMENT ATTACHMENT

(75) Inventor: Antonio Cardoso, Kearney, NJ (US)

(73) Assignee: Cruz Construction Corp., Holmdel, NJ (US)

( * ) Notice: Subject to any disclaimer, the term of this patent is extended or adjusted under 35 U.S.C. 154(b) by 0 days.

(21) Appl. No.: 10/840,136

(22) Filed: May 6, 2004

(65) Prior Publication Data

US 2005/0247461 A1 Nov. 10, 2005

(51) Int. Cl.

| | |
|---|---|
| ***B23Q 1/28*** | (2006.01) |
| ***B23Q 3/00*** | (2006.01) |
| ***B23Q 16/00*** | (2006.01) |
| *B23Q 5/44* | (2006.01) |

(52) U.S. Cl. ..... 173/13; 173/147

(58) Field of Classification Search ..... 173/13, 173/28, 119, 134, 147, 162, 164; 175/122, 175/135, 162, 220; 405/232

See application file for complete search history.

(56) References Cited

U.S. PATENT DOCUMENTS

| | | | | |
|---|---|---|---|---|
| 3,181,623 | A * | 5/1965 | Lindgren | 173/185 |
| 3,333,646 | A * | 8/1967 | Hoen et al. | 173/27 |
| 3,442,338 | A * | 5/1969 | Broderson | 173/86 |
| 3,490,548 | A * | 1/1970 | Lake | 173/193 |
| 4,124,081 | A * | 11/1978 | Deike | 173/28 |
| 4,307,785 | A | 12/1981 | Ortemond | |
| 4,333,541 | A * | 6/1982 | Doty | 175/162 |
| 5,107,934 | A | 4/1992 | Atchison | |
| 5,213,169 | A * | 5/1993 | Heller | 175/122 |
| 5,375,664 | A * | 12/1994 | McDowell et al. | 173/1 |
| 5,551,519 | A | 9/1996 | Pach | |
| 6,047,771 | A * | 4/2000 | R.o slashed.ynestad | 166/77.52 |
| 6,234,719 | B1 * | 5/2001 | Roynestad | 405/232 |

FOREIGN PATENT DOCUMENTS

| | | |
|---|---|---|
| JP | 10-60889 | 3/1989 |

* cited by examiner

*Primary Examiner*—Rinaldi I. Rada
*Assistant Examiner*—Nathaniel Chukwurah
(74) *Attorney, Agent, or Firm*—Keith Taboada, Esq.; Patterson & Sheridan, LLP

(57) ABSTRACT

A construction equipment attachment for driving an object, such as a timber piles, steel piles, pipe piles, steel sheet piles, h-beam and the like, is provided. In one embodiment, the attachment includes a hammer slidably coupled to a lead, a lead mounting assembly and a hydraulic actuator coupled to the lead and the lead mounting assembly. The hydraulic actuator is adapted to control the orientation of the lead relative to the lead mounting assembly. In another embodiment, the attachment may be for a self-propelled heavy construction machine. In another embodiment, a self-propelled heavy construction machine having a lead positionable along three axes is provided.

17 Claims, 8 Drawing Sheets

LEAD ALIGNMENT ATTACHMENT

BACKGROUND OF THE INVENTION

1. Field of the Invention

Embodiments of the present invention generally relate to a construction equipment attachment for aligning a lead and hammer with an object to be driven. The invention is particularly suitable for driving objects such as a timber piles, steel piles, pipe piles, steel sheet piles, h-beam and the like, into the earth.

2. Description of the Related Art

Buildings, bridges and other structures often require pilings driven into the earth in order to either reach strata suitable for supporting the load of the structure or to a depth that the frictional force between the earth and the pile is sufficient to safely support the structure. For many larger structures, the pilings are driven through the soil to the underlying bedrock, which may lie a considerable distance below the earth's surface. To reach such depths, piles are driven utilizing heavy construction equipment that can deliver blows exceeding 7 tons per impact.

FIG. 1 depicts a simplified schematic drawing of a conventional pile driving system 100. The pile driving system 100 typically includes a lead 102 and a hammer 104 suspended by a crane 106. The hammer 104 is coupled to and is free to slide linearly along the lead 102. The lead 102 includes a stop at its lower end to prevent the hammer 104 from disengaging from the lead 102. The lead 102 is positioned by the crane 106 and the piling is hoisted into position alongside the lead 102. The hammer 104 is lowered by the crane 106 to engage the hammer 104 with the piling. During this operation, the lead 102 and piling are manually aligned to the planned position for driving.

The suspended lead 102 relies on gravity and one or more tethers 116 to maintain a vertical orientation and provides a guide for both the hammer 104 and the piling 108 to be driven into the ground 110. The hammer 104 is typically powered by air or hydraulics to provide reciprocating blows to the top of the piling 108 to force the piling into the ground 110. Although the lead 102 may be tethered at its lowered end by a cable or linkage 116 to the crane 106 to maintain the alignment of the lead 102 with the piling 108, it is difficult to maintain the hammer 104 and piling 108 on a coaxial orientation. If the hammer 104 is not maintained in a true coaxial orientation with the piling 108, the piling will be impacted at an angle relative to the centerline of the piling. Thus, the full force of each hammer blow will not be complete transmitted into a force directing the piling 108 into the ground 110.

The load bearing capability of the piling may be determined at the construction site by counting the number of hammer blows of a known force required to drive the piling a unit distance into the ground. Thus, if the piling and lead are misaligned and the full force of the hammer blow does not force the piling downward, the number of blows per unit distance that the piling is driven will erroneously indicate piling load bearing capacity as being greater than the true load bearing capacity of the piling. False load bearing information may result in unwanted settling of structures built on the pilings, or even catastrophic structural failure.

Another major challenge when using conventional suspended leads is the avoidance of overhead power lines and other overhead obstacles. Power lines at construction sites make it difficult to maneuver the crane and lead into operating position, and in some instances, must be removed to provide enough clearance for the crane to adequately support the lead or support the head over the planned pile position. Removal of these obstacles presents a major and expensive challenge to contractors charged with driving the pilings.

Therefore, there is a need for an improved pile driving device.

SUMMARY OF THE INVENTION

Embodiments of the invention generally provide a construction equipment attachment for aligning a lead and hammer with an object to be driven, such as a timber piles, steel piles, pipe piles, steel sheet piles, h-beam and the like. In one embodiment, the attachment includes a hammer slidably coupled to a lead, a lead mounting assembly and a hydraulic actuator coupled to the lead and the lead mounting assembly. The hydraulic actuator is adapted to control the orientation of the lead relative to the lead mounting assembly.

In another embodiment, an attachment for a self-propelled heavy construction machine is provided. The attachment allows for the alignment of a lead with a workpiece utilizing existing hydraulic fluid control ports of the machine.

In yet another embodiment, a self-propelled heavy construction machine having a lead positionable along three axes is provided.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The invention generally provides an improved pile driving attachment that is adapted to readily attach to an excavator or other heavy construction machine. The invention facilitates alignment between a hammer of the pile driving apparatus and a workpiece, such as timber piles, steel piles, pipe piles, steel sheet piles, h-beam and the like, so that the force from the hammer is efficiently utilized to drive the workpiece. Moreover, the invention allows for pile driving operations to be conducted in and around crowded construction sites, including those with overhead obstacles, which make operation of conventional pile driving equipment difficult, unsafe and/or costly to operate.

Figure 1:
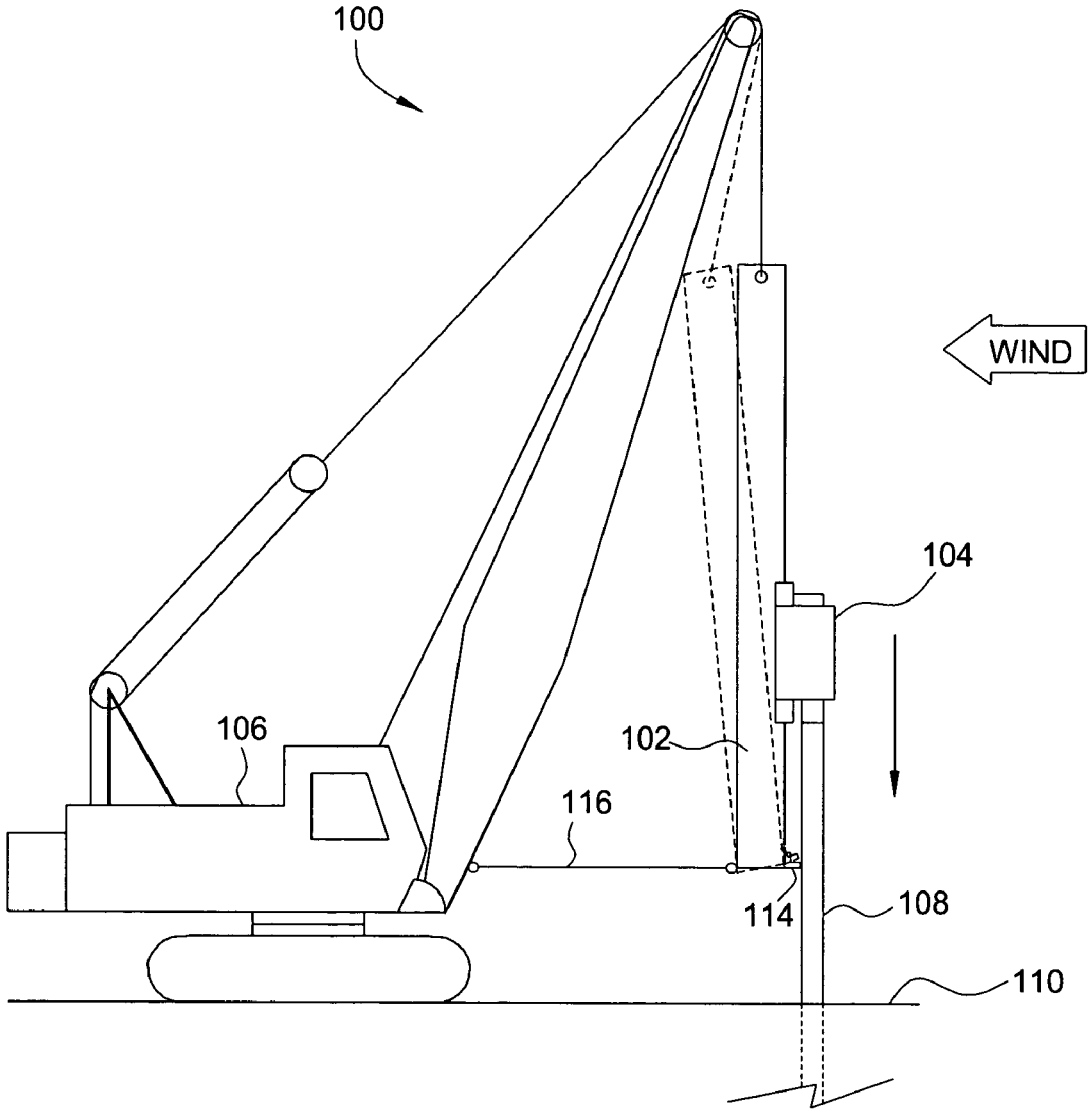
FIG. 1 (PRIOR ART)
FIG. 1 is a simplified schematic diagram of a conventional pile driving device.
Figure 2:
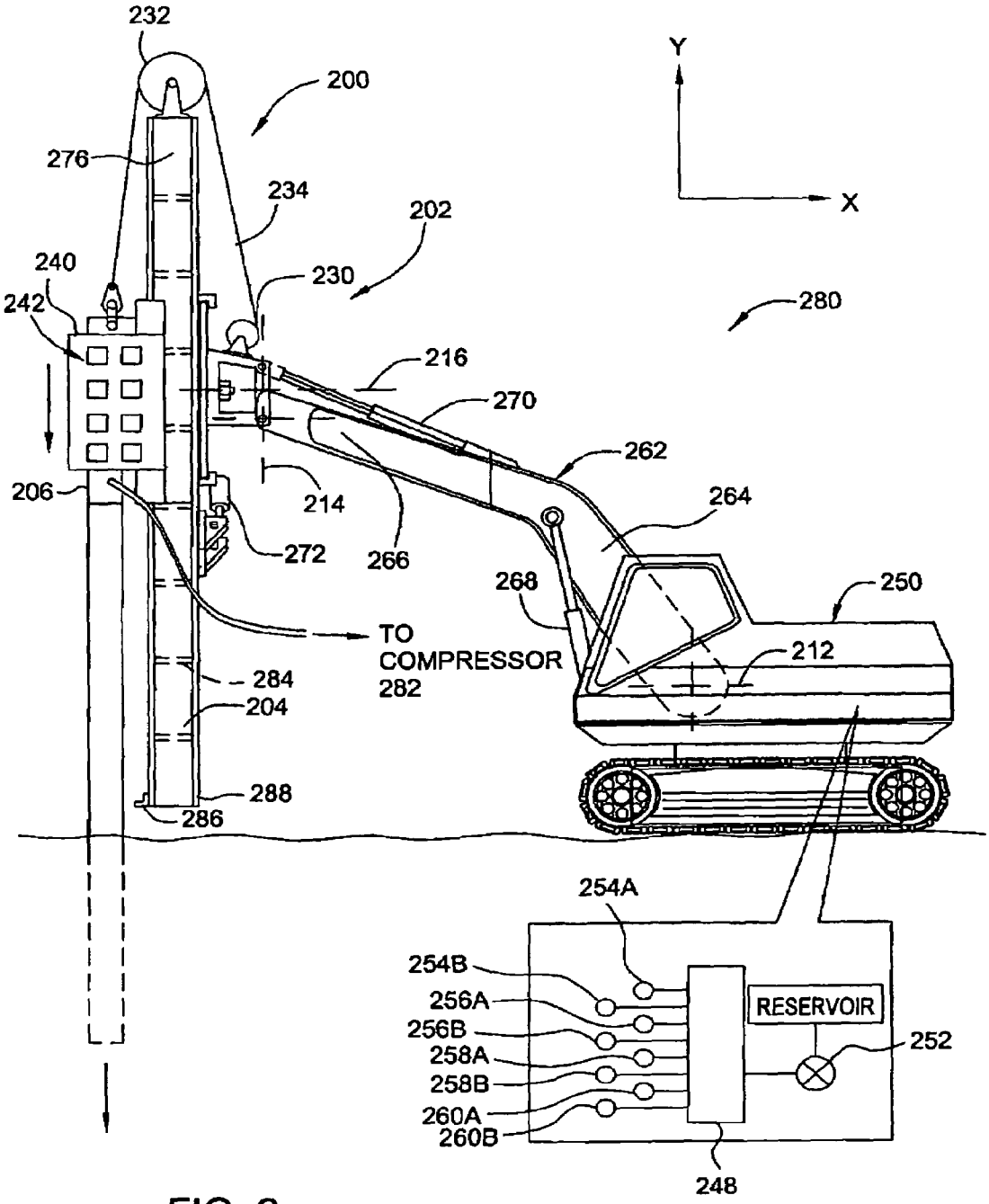
FIG. 2 is a side elevation of pile driver having a pile driving apparatus of the present invention.

FIG. 2 is an elevation of a pile driver 280 having a pile driving attachment 200 of the present invention coupled to a self-propelled, off-road capable, heavy construction machine 250. The pile driving attachment 200 generally includes a lead mounting assembly 202, a lead 204 and a hammer 206. The lead mounting assembly 202 generally controls the orientation of the lead 204 about at least two axes of rotation. The hammer 206 is retained to, and slides freely along the lead 204. Typically, the lead 204 has a hammer stop 286 at least at a lower end 288 of the lead 204 to prevent the hammer 206 from disengaging from the lead 204. In the embodiment depicted in FIG. 2, the hammer 206 is powered by a compressor 282. The hammer 206 is generally configured similar to the hammer 104 discussed above. One suitable hammer is available from Vulcan Foundation Equipment, located in Chattanooga, Tenn.

The self-propelled machine 250 includes at least one hydraulic pump 252 and control manifold 248 providing control of hydraulic fluid through at least eight ports 254A, 254B, 256A, 256B, 258A, 258B, 260A, 260B. The self-propelled machine 250 generally has at least a 50-ton weight and is configured to accept a boom 262, for example, in an excavator configuration. Self-propelled machines 250 having hydraulic ports providing fluid control for various attachments to the machines 250 are well known. In one embodiment, the self-propelled machine 250 is a Model 345B Excavator available from Caterpillar, Inc., of Peoria, Ill. It is contemplated that self-propelled machines may alternatively comprise other heavy construction equipment adapted for use with the pile driving attachment 200.

The boom 262 is coupled at a first end 264 to the self-propelled machine 250 and to the pile-driving attachment 200 at a second end 266. The boom 262 has a first axis of rotation 212 defined at the first end 264. As the boom 262 is raised or lowered, the pile driving attachment 200 is moved relative to the self-propelled machine 250 relative to the first axis of rotation 212. At least one first cylinder 268 is coupled to the ports 254A–B to control the rotation of the boom 262 relative to the first axis of rotation 212. Hydraulic lines coupled to the ports 254A–B have been omitted from the Figures for clarity.

The second end 266 of the boom 262 is coupled to the lead mounting assembly 202 of the pile driving attachment 200. A second cylinder 270 is coupled between the lead mounting assembly 202 and the boom 262. The second cylinder 270 is coupled to the pump 252 through the ports 256A–B to control the rotation of the lead mounting assembly 202 around a second axis of rotation 214 defined at the attachment of the second end 266 of the boom 262 to the lead mounting assembly 202. In one embodiment, the second axis 214 is orientated substantially parallel to the first rotational axis 212.

The lead 204 is rotationally coupled to the lead mounting assembly 202. A third cylinder 272 is coupled between the lead 204 and the lead mounting assembly 202. The third cylinder 272 is coupled to the pump 252 through the ports 258A–B to control the rotational orientation of the lead 204 relative to the lead mounting assembly 202 around a third rotational axis 216. In one embodiment, the third axis 216 is orientated substantially perpendicular to the first and second rotational axes 212, 214. The third cylinder 272 may alternatively be a hydraulic actuator, lead screw or other actuator, hydraulic or electric, suitable for rotating the lead 202 and hammer 204.

Figure 3:
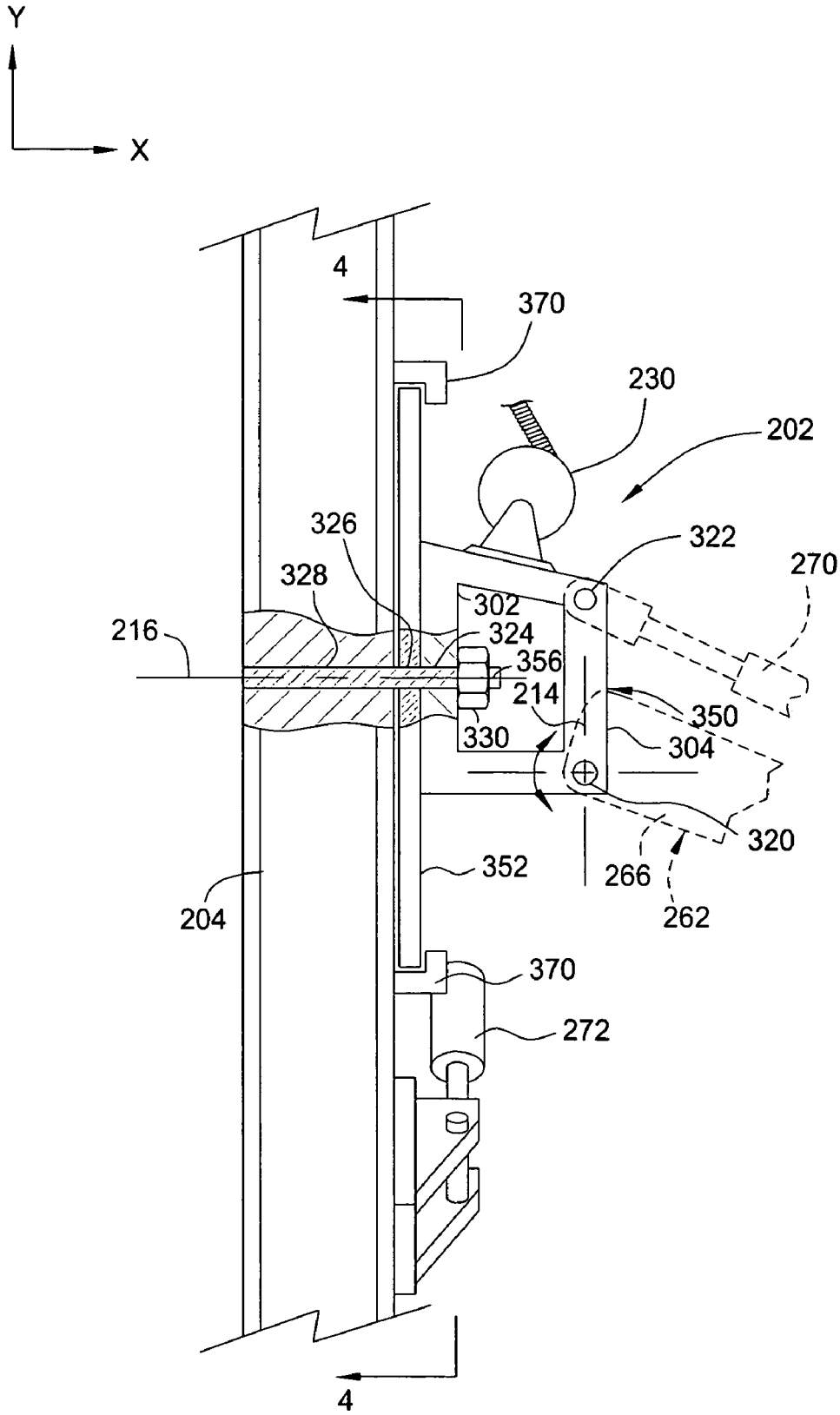
FIG. 3 is a side elevation of the pile driving apparatus of FIG. 2.
Figure 4:
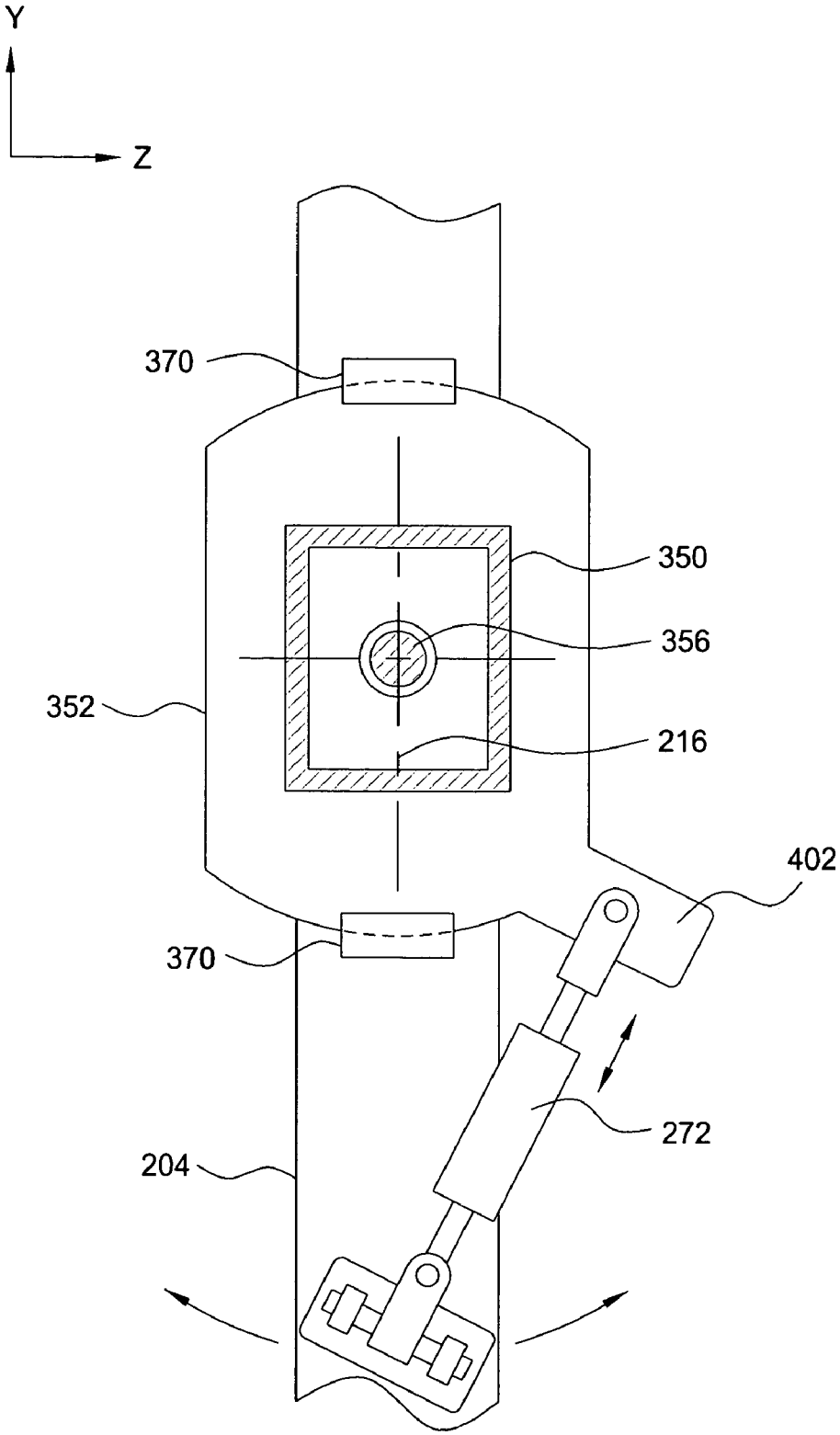
FIG. 4 is a partial sectional view of the pile driving apparatus taken along section line 4—4 of FIG. 3.

Referring to FIGS. 3–4, the lead mounting assembly 202 is pivotably coupled to the lead 204 by a shaft 356. The lead mounting assembly 202 includes a mounting bracket 350 coupled to a mounting plate 352, typically by welding. The mounting bracket 350 is coupled to the boom 262 (shown in phantom in FIG. 3). The third cylinder 272 (also shown in phantom in FIG. 3) is coupled between the lead 204 and mounting plate 352 to control the rotational orientation therebetween. In one embodiment, the third cylinder 272 is coupled to a cylinder mounting flange 402 extending from the mounting plate 352 while a second end of the third cylinder 272 is coupled to the lead 204, and is capable of rotating the lead 204 through 30 degrees around the axis 216.

The mounting bracket 350 includes a first side 304 and a second side 302. The first side 304 of the mounting bracket 350 includes a first hole 320 and a second hole 322. The holes 320, 322 are generally formed in a spaced-apart relation and have substantially parallel centerlines. The first hole 320 is coaxial with the second axis of rotation 214 and facilitates coupling of the mounting bracket 350 to the second end 266 of the boom 262 by a pin or shaft (not shown).

Figure 5:
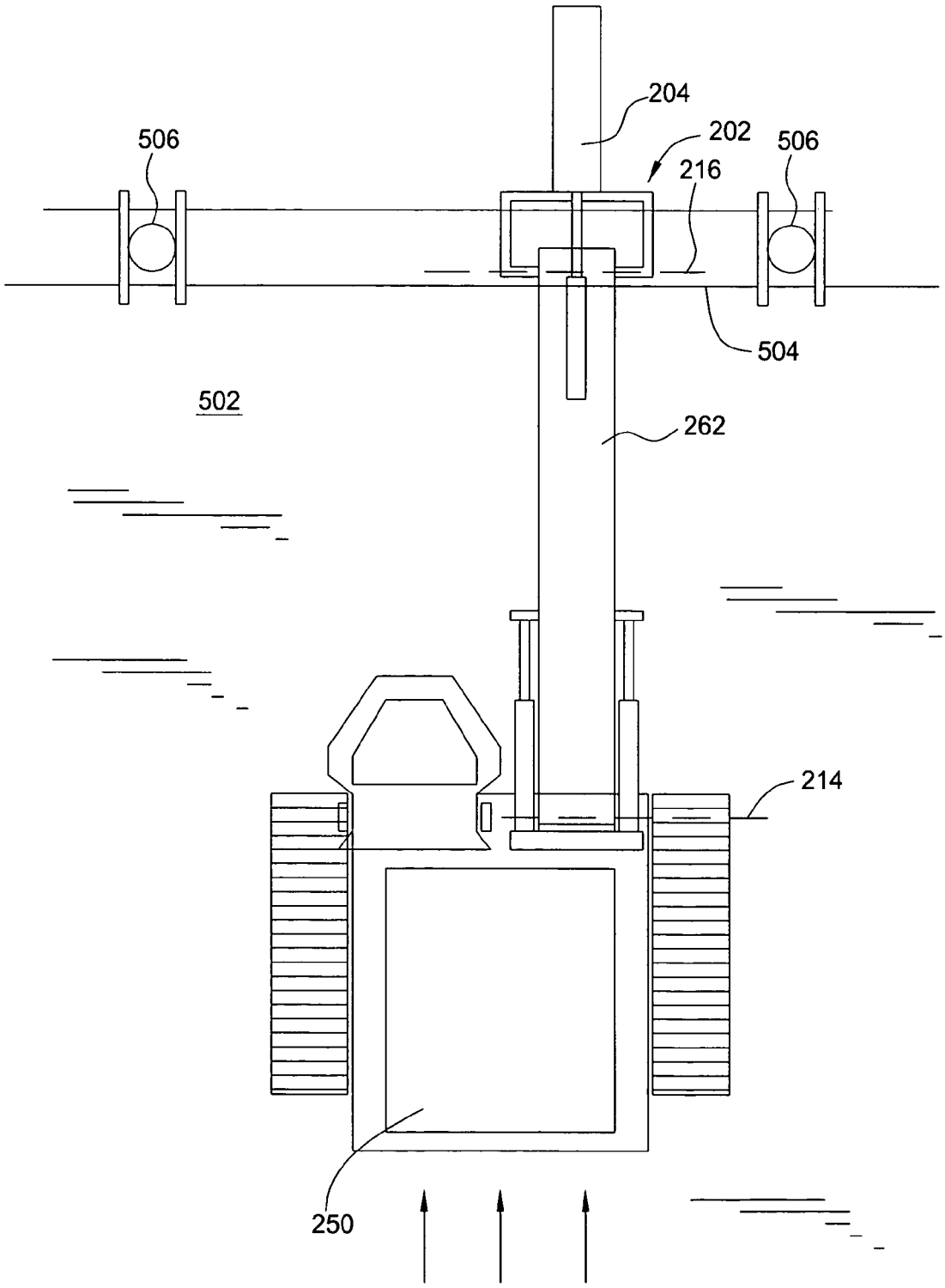
FIG. 5 is a top view of the pile driver of FIG. 2.

The second hole 322 is positioned to facilitate coupling of the second cylinder 270 to the mounting bracket 350. Generally, the second hole 322 is located to allow the lead 202 to be rotated into an orientation below the boom 262 substantially parallel to the ground (as depicted in FIG. 5).

The second side 302 of the lead mounting bracket 202 includes a third hole 324. The third hole 324 has a centerline substantially perpendicular to the centerlines of the first and second holes 320, 322, and is coaxial with the third axis of rotation 216.

The shaft 356 is disposed through third hole 324 and holes 326, 328 formed through the mounting plate 352 and lead 204. The shaft 356 is welded or otherwise fastened to one of the lead mounting assembly 202 or lead 204. In the embodiment depicted in FIG. 3, the shaft 356 is welded to the lead 204 and is retained to the mounting bracket 350 by a nut 330, thereby allowing the shaft 356 to rotate in the holes 324, 326 of the lead mounting assembly 202. It is contemplated that the lead mounting assembly 202 or lead 204 may be rotationally coupled thereto in an alternative manner.

The lead 204 may additionally include a pair of retaining tabs 370 that capture the mounting plate 352 to the lead 204. The tabs 370 are spaced from the lead 204 to facilitate rotation of the mounting plate 352.

Referring back to FIG. 2, the pile driving attachment 200 may include one or more optional features that facilitate operation. In one embodiment, a winch 230 is mounted to the lead mounting assembly 202. A cable 234 from the winch 230 is run through a pulley 232 coupled to a distal end (or top) 276 of the lead 204. The winch 230 allows the hammer 206 to be positioned along the lead 204 while the lead 204 is in a non-horizontal orientation. The winch 230 may also be utilized to move or support workpieces. In the embodiment depicted in FIG. 2, the winch 230 is hydraulically driven and is coupled to the pump through ports 260A–B. Alternatively, the winch 230 may be coupled to the boom 262 or self-propelled machine 250.

In another embodiment, the hammer 206 may be laterally shielded by a cage 240. The cage 240 is generally fabricated from steel or strong material, and is configured to move along the lead 204 with the hammer 206. The cage 240 may include an integral ladder 242 having a parallel orientation relative to the lead 204. In the embodiment depicted in FIG. 2, the cage 240 has a "C-section", with the open end of the cage 240 facing away from the lead 204, thereby allowing the workpiece to be laterally support by the gage 280 before engaging the hammer 206.

Alternatively, the cage 240 may be coupled to the lead 204, the cage 240 extends along the length of the lead 204 so that the hammer 206 is shielded at every position along the lead 204.

In yet another embodiment, the lead 204 may include a plurality of holes 284 (shown in phantom in FIG. 2) formed therethrough. The holes 284 are configured to accept a pin (not shown). The holes 284 allow the hammer 206 to be pre-positioned on the lead 204 before rotating the lead 204 into a vertical position. This advantageously allows the hammer 206 to engage a workpiece without lifting the lower end 288 of the lead 204 above the workpiece, thereby reducing the vertical clearance required over the workpiece.

Figure 6:
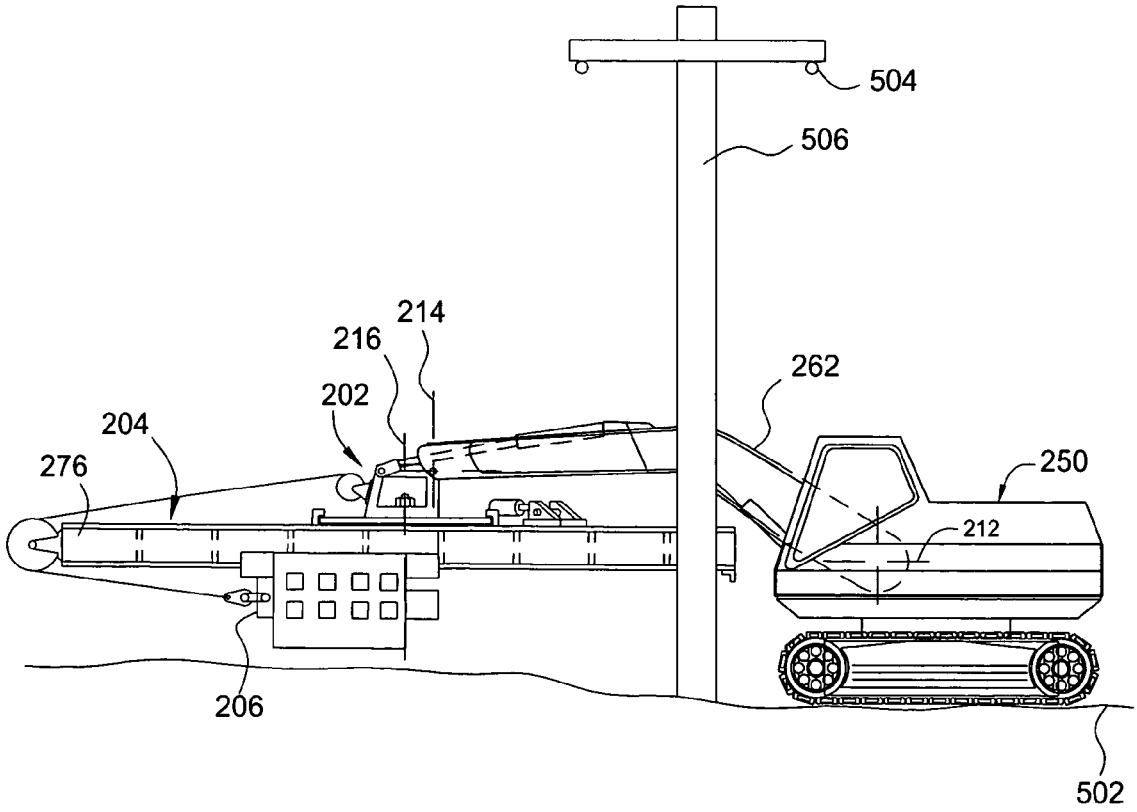
FIGS. 6–8 are side elevations of the pile driver of FIG. 2.

FIGS. 5–6 depict the pile driving attachment 200 in operation. As described above, the lead 204 may be rotated into a position substantially horizontal to the ground 502 below the boom 262 into a position substantially horizontal to the ground. With the lead 204 in this position, the operator of the self-propelled machine 250 may easily navigate the machine 250 and lead 204 underneath overhead obstacles such as power transmission lines 504. Moreover, as the lead 204 and boom 262 are aligned with the direction of travel of the self-propelled machine 250, avoidance of vertical obstacles 506 is facilitated as the lead 204 is positioned in front of the machine 250 while the vehicle is in motion, thereby enabling the operator to maintain both the drive path of the vehicle and the entire lead 204 in the operator's field of view.

Figure 7:
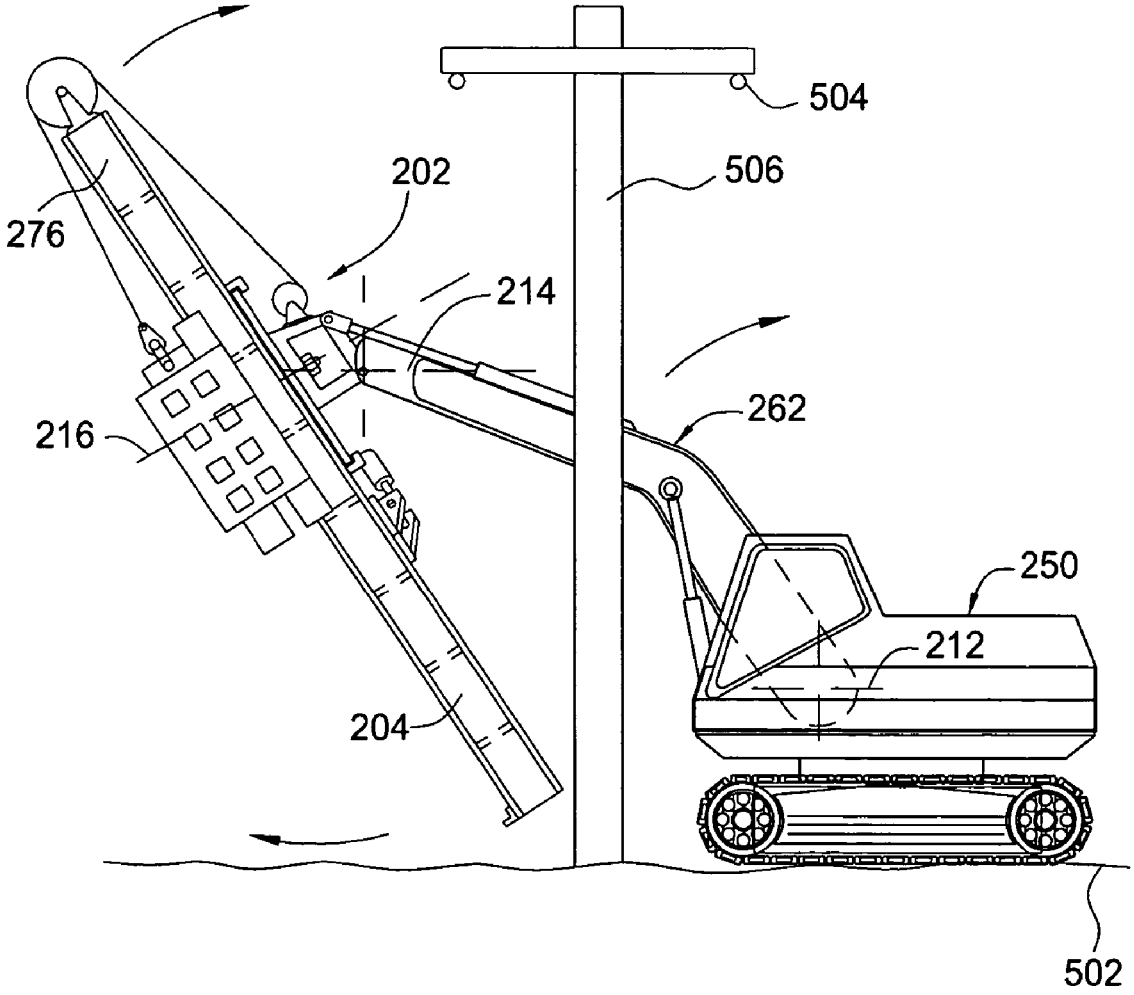
Figure 8:
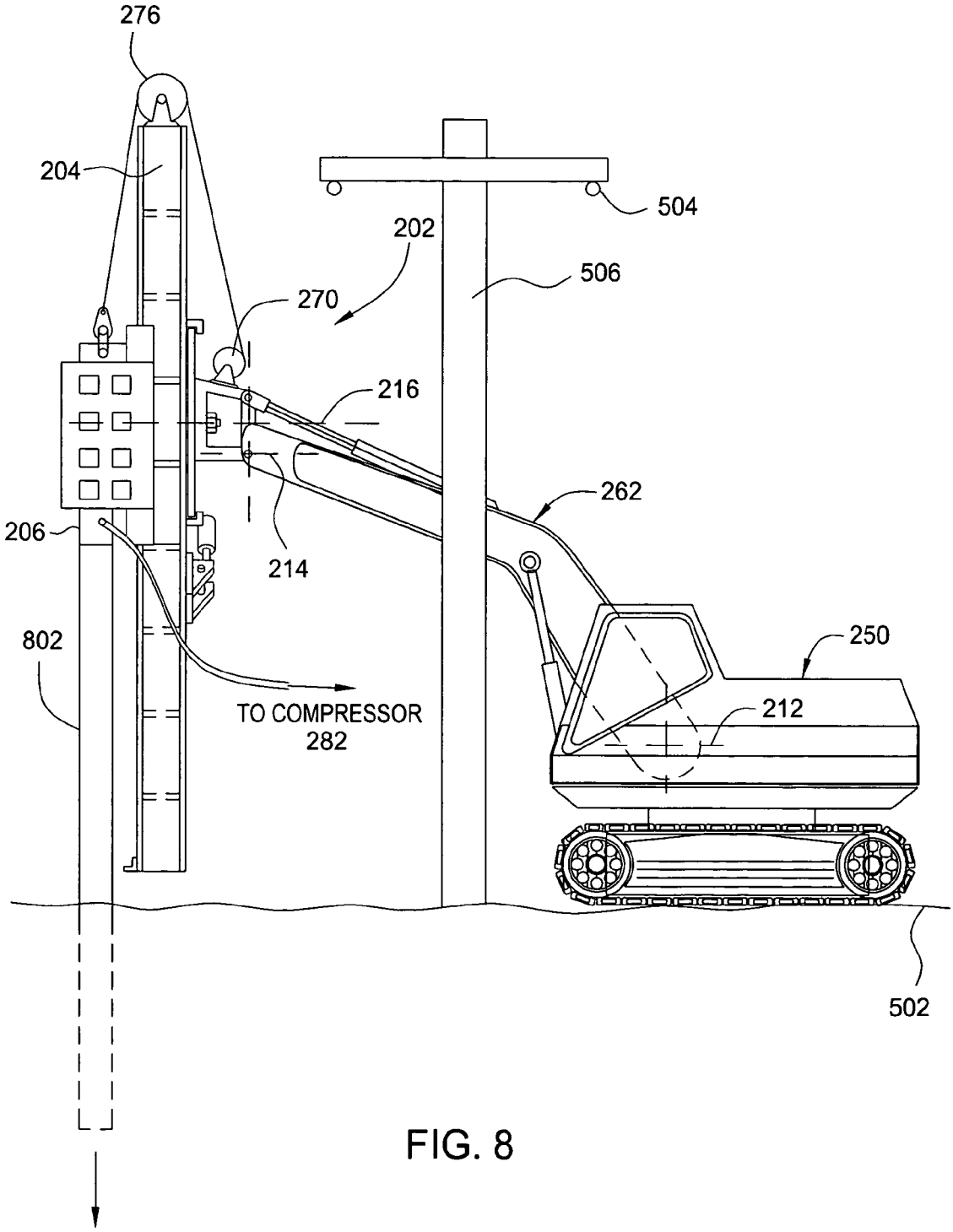

FIGS. 6–8 illustrate the lead 204 being rotated about the second axis of rotation 214 into a substantially vertical position to facilitate driving a workpiece, shown as a piling 802. As illustrated in FIGS. 6–8, the top 276 of the lead 204 remains in front of the vehicle operator as the lead is rotated, thereby allowing overhead obstacles 504 to be easily avoided while simultaneously positioning the hammer 206 relative to the piling 802. Moreover, positioning the lead 204 in this manner allows the pile driving attachment 200 to align the lead 204 and drive pilings while the self-propelled machine 250 is positioned below an overhead obstacle 504, advantageously allowing the pile driving attachment 200 to efficiently operate in crowded worksites.

Moreover, as the winch 230 can position the hammer along the lead 204 while the lead 204 is in a vertical position, the lead 204 does not have to be elevated in order for the hammer 206 to be set upon a piling. This allows the pile driving attachment 200 to be operated with minimal clearance above the piling 802.

Once the hammer 206 is set upon the piling, the hammer 206 and lead 204 are aligned with the piling 802 by rotating the lead 204 about the second and third axes 214, 216. The hammer 204 is then activated to drive the piling 802 into the ground 606. Although the piling 802 shown in FIGS. 6–8 is depicted in a substantially vertical orientation, the lead 204 is well-suited for driving pilings inclined at an angle from vertical by rotating the lead around at least one of the second and/or third axes 214, 216.

Thus, a piling driving apparatus has been provided having an improved lead alignment apparatus. The lead alignment apparatus is advantageously suited for attachment to existing heavy construction equipment, such as an excavator, utilizing the hydraulics provided by that equipment to position the lead without additional pumps or motors. Moreover, the lead may be readily aligned with a piling in any orientation, such that the hammer provides a driving force coaxial with the pile. Additionally, the lead alignment apparatus may be rotated substantially horizontal to the ground, thereby allowing the pile driver to safely move in a job site having tight clearances between overhead and vertical obstructions.

While the foregoing is directed to embodiments of the present invention, other and further embodiments of the invention may be devised without departing from the basic scope thereof, and the scope thereof is determined by the claims that follow.

What is claimed is:

1. An attachment for a construction machine having a boom operably thereto, the attachment comprising:

a lead;

a hammer slidably coupled to the lead; and a lead mounting assembly coupling the lead to a boom and configured to allow positioning of the lead in two planes relative to the boom, wherein the lead mounting assembly further comprises:

a mounting plate pivotably coupled to the lead and having at least one curved surface captured by a tab extending from the lead.

2. An attachment for driving an object, comprising:

a lead;

a hammer slidably coupled to the lead;

a lead mounting assembly pivotably coupled to the lead and having a mounting arrangement configured to allow rotation of the lead in a first plane; and a hydraulic actuator coupled to the lead and the lead mounting assembly, the hydraulic actuator adapted to control the orientation of the lead relative to the lead mounting assembly in second plane that is different than the first plane, wherein the lead mounting assembly further comprises:

a mounting plane;

a pivot coupled to and defining an axis of rotation between the mounting plate and lead; and a retainer securing an outer portion of the mounting plate to the lead while allowing rotation between the mounting plate and the lead.

3. The attachment of claim 2 further comprising:

a winch coupled to the lead mounting assembly.

4. The attachment of claim 2 further, wherein the lead mounting assembly further comprises:

a first mounting hole adapted for coupling to construction equipment, the first hole having a center line substantially perpendicular to the lead.

5. The attachment of claim 4, wherein the center line of the hole is perpendicular to an axis of rotation of the lead relative to the lead mounting assembly.

6. The attachment of claim 2, wherein the mounting assembly further comprises:

a mounting bracket having a first hole for coupling to a boom of an excavator and a second mounting hole for coupling to a hydraulic actuator adapted to rotate the mounting bracket relative to the boom relative to an axis of rotation defined by a the first hole.

7. The attachment of claim 6, wherein the lead mounting assembly further comprises:

a mounting plate coupled to the mounting bracket; and a shaft coupled between the mounting plate and the lead, the shaft coaxial with an axis of rotation of the lead relative to the mounting plate.

8. The attachment of claim 2, wherein the lead further comprises:

a plurality of holes formed therein and adapted to accept a pin for limiting the travel of the hammer.

9. The attachment of claim 2 further comprising:

a cage shielding the hammer and adapted to travel with the hammer along the lead.

10. The attachment of claim 9, wherein the cage further comprises an integral ladder.

11. The attachment of claim 2, wherein the mounting plate further comprises:

a curved edge defined at a predefined radius from the pivot.

12. The attachment of claim 11, wherein the retainer is fastened to the lead and extends over the curved edge towards the pivot.

13. An attachment for a self-propelled, heavy construction machine having a boom rotationally coupled thereto and a plurality of hydraulic control fluid ports, the attachment comprising:

a lead;

a hammer slidably coupled to the lead; and a lead mounting assembly coupling the lead to the boom, the lead mounting assembly having a boom mounting hole defining a first axis of rotation substantially perpendicular to the lead, wherein the lead is rotational relative to the lead mounting assembly about a second axis of rotation substantially perpendicular to the first axis of rotation, wherein the lead mounting assembly further comprises:

a second boom mounting hole having a centerline parallel to the first axis of rotation and disposed on an opposite side of the second axis of rotation relative to the first boom mounting hole;

a mounting bracket having the first boom mounting hole formed therein;

a mounting plate coupled to the mounting bracket; and a shaft coupled between the mounting plate and the lead, the shaft coaxial with the second axis of rotation; and a retainer securing an outer portion of the mounting plate to the lead while allowing rotation between the mounting plate and the lead.

14. The attachment of claim 13, wherein the attachment further comprises:

a hydraulic actuator coupled to the lead and the lead mounting assembly, the hydraulic actuator adapted to control the orientation of the lead relative to the lead mounting assembly and adapted for coupling to existing hydraulic fluid control ports of the construction machine.

15. The apparatus of claim 13 further comprising:

a winch coupled to the lead mounting assembly or the boom.

16. The attachment of claim 13, wherein the lead further comprises:

a plurality of holes formed therein and adapted to accept a pin for limiting the travel of the hammer.

17. The attachment of claim 13 further comprising:

a cage shielding the hammer and adapted to travel with the hammer along the lead.

* * * * *